US010065184B2

(12) United States Patent
Marshall et al.

(10) Patent No.: US 10,065,184 B2
(45) Date of Patent: Sep. 4, 2018

(54) PIPETTE HAVING INTEGRATED FILTRATION ASSEMBLY

(71) Applicant: BacterioScan LTD, MP Western Galilee (IL)

(72) Inventors: Dana A. Marshall, St. Louis, MO (US); Robert W. Beckmann, St. Louis, MO (US)

(73) Assignee: BacterioScan Ltd., MP Western Galilee (IL)

( * ) Notice: Subject to any disclaimer, the term of this patent is extended or adjusted under 35 U.S.C. 154(b) by 123 days.

(21) Appl. No.: 14/978,826

(22) Filed: Dec. 22, 2015

(65) Prior Publication Data

US 2016/0184743 A1 Jun. 30, 2016

Related U.S. Application Data

(60) Provisional application No. 62/098,166, filed on Dec. 30, 2014.

(51) Int. Cl.
*B01D 27/10* (2006.01)
*B01L 3/02* (2006.01)

(52) U.S. Cl.
CPC ..... *B01L 3/0275* (2013.01); *B01L 2300/0681* (2013.01); *B01L 2400/0605* (2013.01)

(58) Field of Classification Search
CPC ..... B01L 3/0275; B01L 3/502; B01L 3/5632; B01L 2300/0681; B01L 2400/0605
USPC ..... 210/130–132, 136
See application file for complete search history.

(56) References Cited

U.S. PATENT DOCUMENTS

| | | | |
|---|---|---|---|
| 3,627,424 | A | 12/1971 | Dorman et al. |
| 3,713,775 | A | 1/1973 | Schmitz |
| 3,832,532 | A | 8/1974 | Praglin et al. |
| 3,928,140 | A | 12/1975 | Wyatt et al. |
| 4,066,079 | A | 1/1978 | Chiarolla |
| 4,066,360 | A | 1/1978 | Breddin et al. |

(Continued)

FOREIGN PATENT DOCUMENTS

| | | |
|---|---|---|
| DE | 19806780 C1 | 7/1999 |
| DE | 10128978 | 12/2002 |

(Continued)

OTHER PUBLICATIONS

International Search Report, PCTIB2015/060033, dated Mar. 27, 2016 (3 pages).

(Continued)

*Primary Examiner* — Terry K Cecil
(74) *Attorney, Agent, or Firm* — Nixon Peabody LLP

(57) ABSTRACT

The present invention is a pipette-filtration assembly having a main body defining a first channel, a second channel, a first valve, and a second valve. The first valve is associated with the first channel and permits flow in a first direction while substantially hindering flow in a second direction. The second valve is associated with the second channel and permits flow in the second direction while substantially hindering flow in the first direction. At least one filter is used to filter a fluid sample as the fluid sample flows in the first direction and/or the second direction. The pipette-filtration assembly is preferably disposable and includes one or two stages of integral filtration, primarily for use with an air-displacement pipetting or transfer system.

17 Claims, 6 Drawing Sheets

(56) References Cited

U.S. PATENT DOCUMENTS

| | | | |
|---|---|---|---|
| 4,101,383 | A | 7/1978 | Wyatt et al. |
| 4,113,386 | A | 9/1978 | Lepper, Jr. |
| 4,119,407 | A | 10/1978 | Goldstein et al. |
| 4,265,538 | A | 5/1981 | Wertheimer |
| 4,577,970 | A | 3/1986 | Meserol |
| 4,754,613 | A | 7/1988 | Brito |
| 4,874,102 | A | 10/1989 | Jessop |
| 4,895,446 | A | 1/1990 | Maldari et al. |
| 5,139,031 | A | 8/1992 | Guirguis |
| 5,187,368 | A | 2/1993 | Galante et al. |
| 5,212,667 | A | 5/1993 | Tomlinson, Jr. et al. |
| 5,351,118 | A | 9/1994 | Spinell |
| 5,616,923 | A | 4/1997 | Rich et al. |
| 5,693,944 | A | 12/1997 | Rich |
| 5,969,814 | A | 10/1999 | Barber |
| 5,989,499 | A | 11/1999 | Catanzariti |
| 6,091,483 | A | 7/2000 | Guirguis |
| 6,230,045 | B1 | 5/2001 | Hoogenraad et al. |
| 6,333,008 | B1 | 12/2001 | Leistner et al. |
| 6,573,992 | B1 | 6/2003 | Drake |
| 6,861,230 | B1 | 3/2005 | Murphy et al. |
| 7,430,046 | B2 | 9/2008 | Jiang et al. |
| 7,961,311 | B2 | 6/2011 | Weichselbaum et al. |
| 8,337,470 | B2 * | 12/2012 | Prasad ..... A61M 39/223 137/493.9 |
| 8,339,601 | B2 | 12/2012 | Weichselbaum et al. |
| 9,687,842 | B2 * | 6/2017 | Ito ..... B01L 3/0275 |
| 2002/0086431 | A1 * | 7/2002 | Markham ..... G01N 1/2813 436/63 |
| 2003/0048433 | A1 | 3/2003 | Desjonqueres |
| 2004/0070756 | A1 | 4/2004 | Rastopov |
| 2004/0185552 | A1 | 9/2004 | Grinner et al. |
| 2004/0238746 | A1 | 12/2004 | Dreyer et al. |
| 2005/0148085 | A1 | 7/2005 | Larsen |
| 2005/0214927 | A1 | 9/2005 | Haley |
| 2006/0063146 | A1 | 3/2006 | Larsen et al. |
| 2006/0109476 | A1 | 5/2006 | Werner et al. |
| 2006/0256338 | A1 | 11/2006 | Gratton et al. |
| 2007/0155017 | A1 | 7/2007 | Wyatt |
| 2007/0159619 | A1 | 7/2007 | Chu et al. |
| 2007/0195324 | A1 | 8/2007 | Adams et al. |
| 2007/0206203 | A1 | 9/2007 | Trainer |
| 2007/0211251 | A1 | 9/2007 | Weischselbaum |
| 2007/0253042 | A1 | 11/2007 | Szarvas |
| 2008/0106737 | A1 | 5/2008 | Weichselbaum et al. |
| 2008/0293091 | A1 | 11/2008 | Kanipayor |
| 2010/0277734 | A1 | 11/2010 | Weischselbaum |
| 2013/0089476 | A1 | 4/2013 | Weichselbaum et al. |
| 2014/0377147 | A1 | 12/2014 | Sammler |

FOREIGN PATENT DOCUMENTS

| | | |
|---|---|---|
| EP | 0320154 | 6/1989 |
| EP | 1136563 | 9/2001 |
| GB | 1515681 | 6/1978 |
| GB | 2344526 | 6/2000 |
| GB | 2412166 | 9/2005 |
| WO | WO 00/09981 | 2/2000 |
| WO | WO 00/66763 | 11/2000 |
| WO | WO 2006/018839 | 2/2006 |
| WO | WO 2013/070948 | 5/2013 |
| WO | WO 2013/153371 | 10/2013 |

OTHER PUBLICATIONS

Written Opinion of the International Searching Authority, PCTIB2015/060033, dated Mar. 27, 2016 (6 pages).

Murray, et al. "Light-scattering methods for antibiotic sensitivity tests", J Clin Pathol, 1980, vol. 33, pp. 995-1001, 8 pages.

* cited by examiner

PIPETTE HAVING INTEGRATED FILTRATION ASSEMBLY

CROSS-REFERENCE TO RELATED APPLICATIONS

This application claims the benefit of U.S. Provisional Application No. 62/098,166, filed Dec. 30, 2014, which is hereby incorporated by reference herein in its entirety.

COPYRIGHT

A portion of the disclosure of this patent document may contain material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to the field of measurements of biological liquid samples. Specifically, the present invention relates to a pipette tip that permits the liquid sample to be filtered so as to remove debris and particulates that might disrupt the measurement.

BACKGROUND OF THE INVENTION

Many applications in the field of analytical research and clinical testing utilize methods for analyzing liquid samples. Among those methods are optical measurements that measure absorbance, turbidity, fluorescence/luminescence, and optical scattering measurements. Optical laser scattering is one of the most sensitive methods, but its implementation can be very challenging, especially when analyzing biological samples in which suspended particles are relatively transparent in the medium.

One particle that often requires evaluation within a liquid is bacteria. The presence of bacteria is often checked with biological liquids, such as urine, amniotic, pleural, peritoneal and spinal liquids. In a common analytical method, culturing of the bacteria can be time-consuming and involve the use of bacterial-growth plates placed within incubators. Normally, laboratory results take several days to determine whether the subject liquid is infected with bacteria.

In some optical measurement systems, cuvettes have been used to receive liquid samples that are then subjected to the optical measurement by transmission of an input beam through the cuvette and observation of the forward scatter signals. These devices have been used relative to the detection of bacteria within the liquid. To optically measure the bacteria, it is often necessary to filter the fluid from other particles. In use, the cuvette is often filled by a pipette assembly that contains the liquid sample. However, filtering the fluid sample prior to transfer to the cuvette or within the cuvette can often be difficult.

Some clinical and research activities involve testing of large numbers of samples, and a variety of semi-standardized air displacement pipetting devices have been developed to simplify transfer of samples between containers while avoiding contamination. These generally involve pulling some volume of air from a disposable pipette tip using a manually actuated cylinder, and pulling liquid into the tip by the vacuum created, and then releasing the sample by moving the cylinder back to the original position, venting the tip to ambient pressure, or by applying an overpressure by use of the same cylinder.

Filtration is used to remove particles of a range of sizes from liquids, and for some medical and lab activities it is common to use a syringe and syringe filter device, which are commonly available. In this arrangement the liquid is drawn into the syringe volume, a filter is attached to the syringe luer fitting, and then the sample is pressed through the filter. This activity requires the assembly of the filter on the syringe after the syringe has been loaded with the sample and thereby exposed to the sample, which might include pathogenic organisms, and is therefore prone to unintended spills, drips, or cross-contamination. Additionally, since the syringe plunger is directly contacting the incompressible sample liquid, it is possible to apply extremely high pressure to the sample, which can crack the filter body leading to spills.

Accordingly, there is a need for an improved pipette assembly with an integrated filter to permit the fluid sample to be easily pulled into the pipette and filtered prior to dispensing the fluid sample.

SUMMARY OF THE INVENTION

The present invention is a pipette-filtration assembly having a main body defining a central channel, an outer channel, a first valve, and a second valve. The first valve is associated with the central channel and permits flow in a first direction while substantially hindering flow in a second direction. The second valve is associated with the outer channel and permits flow in the second direction while substantially hindering flow in the first direction. At least one filter is used to filter a fluid sample as the fluid sample flows in the first direction and/or the second direction.

In a further aspect, the present invention is a pipette-filtration assembly having a main body, a filter mount located within the main body defining a bypass channel and a main channel, a first valve, and a second valve. The first valve is associated with the bypass channel and permits flow in a first direction while substantially hindering flow in a second direction. The second valve is associated with the main channel and a filter and permits flow in the second direction while substantially hindering flow in the first direction. At least one filter is used to filter a fluid sample as the fluid sample flows in the first direction and/or the second direction. The first direction is generally a substantially upward direction with respect to the main body while the second direction is generally a substantially downward direction with respect to the main body.

In another aspect, the present invention is a disposable pipette tip with one or two stages of integral filtration, primarily for use with an air-displacement pipetting or transfer system. This is a low-cost and compact device that can be a replacement for standard pipette tips, but where the liquid being transferred is filtered as it is drawn into the body of the pipette tip, or filtered as it is released from the pipette tip, or filtered in both directions. A two-channel flow check valve is incorporated to divert flow and ensure that filtration is in one-direction only, and that materials filtered during the intake stroke are not merely flushed back into the liquid during release.

Additional aspects of the invention will be apparent to those of ordinary skill in the art in view of the detailed description of various embodiments, which is made with reference to the drawings, a brief description of which is provided below.

Figure 1:
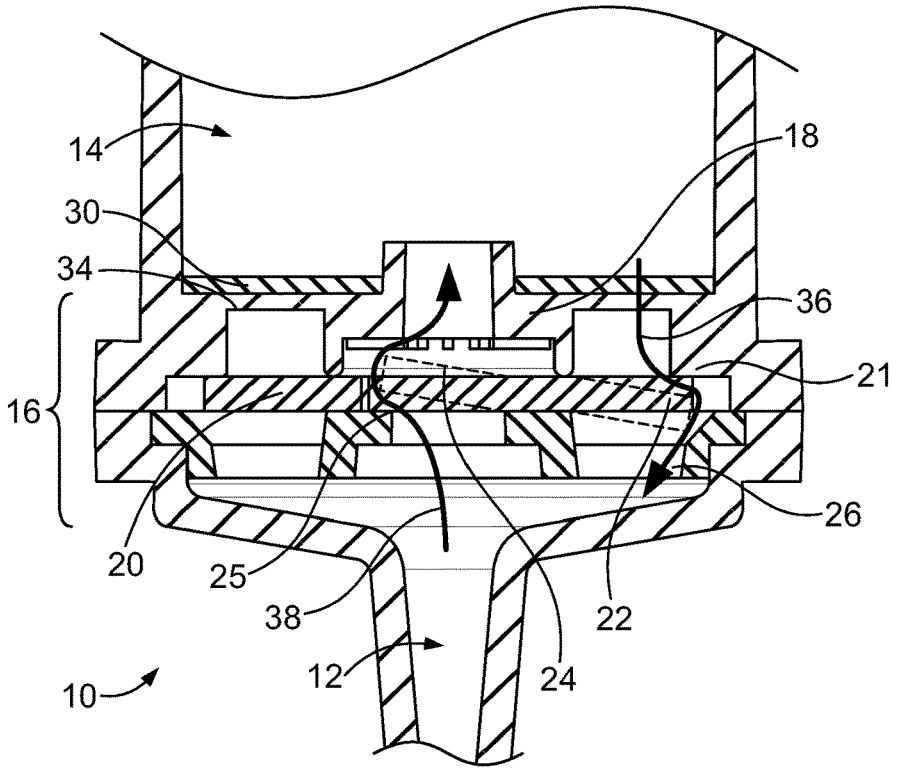
FIG. 1 is a sectional view illustrating the pipette-filtration assembly with a lower tip, a filter portion, and a lower portion of the upper chamber, wherein a thin membrane is configured for flexing open at a first location to permit flow in the central channel and for flexing open at a second location to permit flow of filtered fluid at a peripheral location via an outer channel.

While the invention is susceptible to various modifications and alternative forms, specific embodiments will be shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

The drawings will herein be described in detail with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Figure 2:
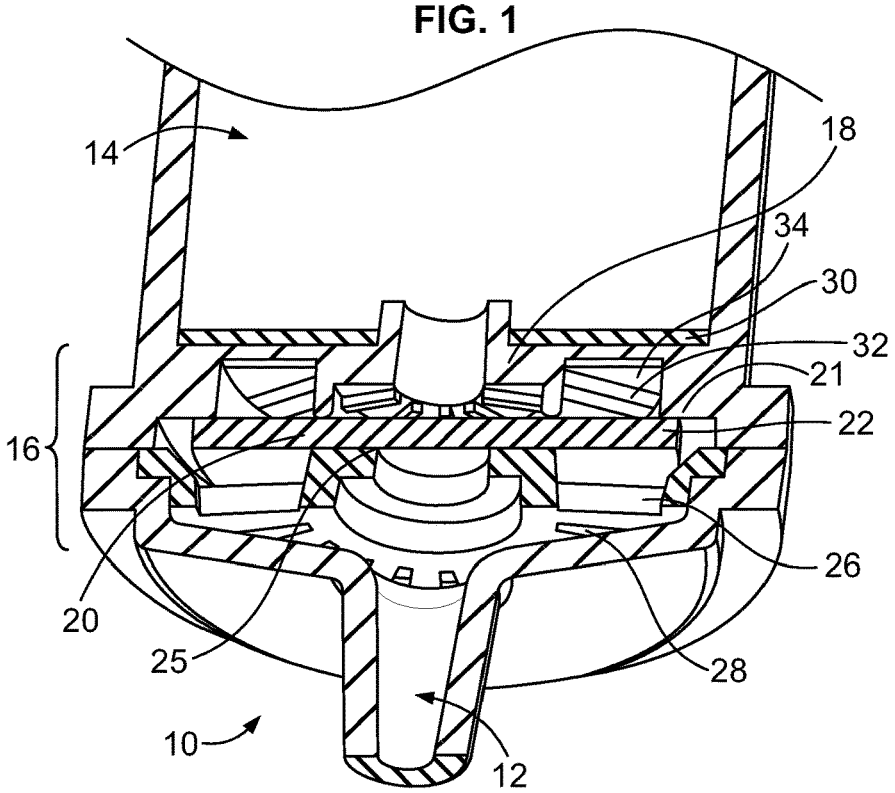
FIG. 2 is an isometric view of the pipette-filtration assembly of FIG. 1.

FIGS. 1 and 2 illustrate one embodiment of the pipette-filtration assembly 10 according to the present invention. The pipette-filtration assembly 10 includes a lower tip 12, an upper chamber 14, and a filter portion 16. The upper chamber 14 is defined by a tubular wall that is standardized to fit an air-displacement pipette that can draw air from the top of the upper chamber 14. The upper chamber 14 may include markings to indicate displaced volume.

The lower tip 12 is a tapered hollow tube with a small aperture at the bottom through which samples can be drawn or released. It is desirable to filter the vast majority of the fluid that is transferred to the pipette-filtration assembly and to minimize the amount of fluid that is not filtered. As such it is advantageous to minimize the enclosed volume in lower tip 12, as this volume may not be fully filtered during the filtering process as described below. The minimum volume of the lower tip 12 may be less than about five percent of the filtered fluid volume, and is generally not more than about ten percent of the transferred fluid volume.

The lower portion of the filter portion 16 is divided into a central inner channel allowing for in-flow of a sample into the upper chamber 14, and an annular outer channel allowing for out-flow from the upper chamber 14. The central inner channel and the annular outer channel are divided from each other by a vertical tubular wall 18.

A flexible membrane 20 is used to restrict flow in one direction, while permitting the flow in the opposing direction. In the illustrated embodiment, the flexible membrane 20 is sandwiched between an upper part (including vertical tubular wall 18) and a lower part of the filter portion 16. The upper side of the filter portion 16 surrounding the inner and outer channels is fitted with a sealing lip 21 around the circumference. The flexible membrane 20 (e.g., a thin rubber or resilient membrane) is fixed to the upper portion of the dividing tube wall 18 between the inner and outer channels at the same position in the filter portion 16 such that a peripheral portion 22 of the membrane 20 contacts and forms a seal on the lip 21 of the outer channel. A pressure on the membrane 20 in one direction will deflect the peripheral portion 22 of the membrane 20 downwardly away from the lip 21 to permit flow from the upper chamber 14, and pressure on the opposite side will force the peripheral portion 22 of the membrane 20 against the sealing lip 21, substantially inhibiting flow into the upper chamber 14. In operation, the fluid sample flows (as shown by arrow 36) around the peripheral portion 22 of the membrane 20 downwardly towards lower wall 26, which includes openings 28 (FIG. 2) leading downwardly toward the lower tip 12. While shown as deflecting away from the lip 21 in a downward direction in the illustrated embodiment, the lip 21 can be positioned below the membrane 20 if the opposing direction of flow is desired.

The membrane 20 can extend across the inner channel tube, and have a slit or a plurality of partial slits or cuts to form one or more deflectable flaps 24. The inner channel is also fitted with a sealing ledge or lip 25 on one side (at the opposite side of the outer channel as sealing lip 21) such that flow in one direction flexes the flap 24 away from the lip 25 to permit flow (as shown by arrow 38), and pressure in the opposite direction forces the membrane 20 against the lip 25 to seal the channel and substantially inhibit flow.

Either or both of inner central or annular outer channels may be fitted with a porous filter 30 such as a glass, plastic, or paper fiber mat, foam, or porous membrane. The filter(s) 30 can be of one or more porosities. Further, the filter(s) 30 could be impregnated with chemo-effectors for modifying the chemistry of the sample, or detection such as colorimetric or luminescent detection, dye, or the addition of drugs, antibodies, nanoparticles, or any other additions to the sample. As shown, the fluid (which is drawn upwardly into the upper chamber 14 via the lower tip 12 and the deflected flap 24) flows downwardly from the upper chamber 14 through the filter 30 and through openings 32 (FIG. 2) in a filter wall 34 that supports the filter 30. The now-filtered fluid then flows around the peripheral portion 22 of the membrane 20 and through the openings 28 in the lower wall 26, where it can then be released via the lower tip 12.

The configuration described in FIGS. 1 and 2 having the filter 30 above the check-valve membrane 20 can be reversed so that the membrane 20 is above the filter 30. Alternatively there could be two levels of filtration, one above and one below the membrane 20. These filter elements can be captured mechanically in their locations to prevent circumvention of flow around the filter(s) 30, or can be welded, adhered, staked, or otherwise secured to the structure of the filter portion 16, the upper chamber 14, or the lower tip 12.

By the above description, one check-valve membrane 20 will permit inflow of fluid to the upper chamber 14 via the opening defined by the flap 24, and the other valve membrane 20 permits discharge of fluid from the upper chamber 14, with capability to include as many as four stages of filtration in the process.

In another version of this device, a valve membrane can be loose in a chamber with a lip on one side, but free to move in the axis of flow to open. In another alternative, there could be two separate membranes—one annular membrane for the outer valve, and an independent element for an inner valve. Additionally, either the inner or outer valve membrane could be staked and flex as is shown in FIGS. 1-2, while the other is free to translate in the axis of flow.

Figure 3A:
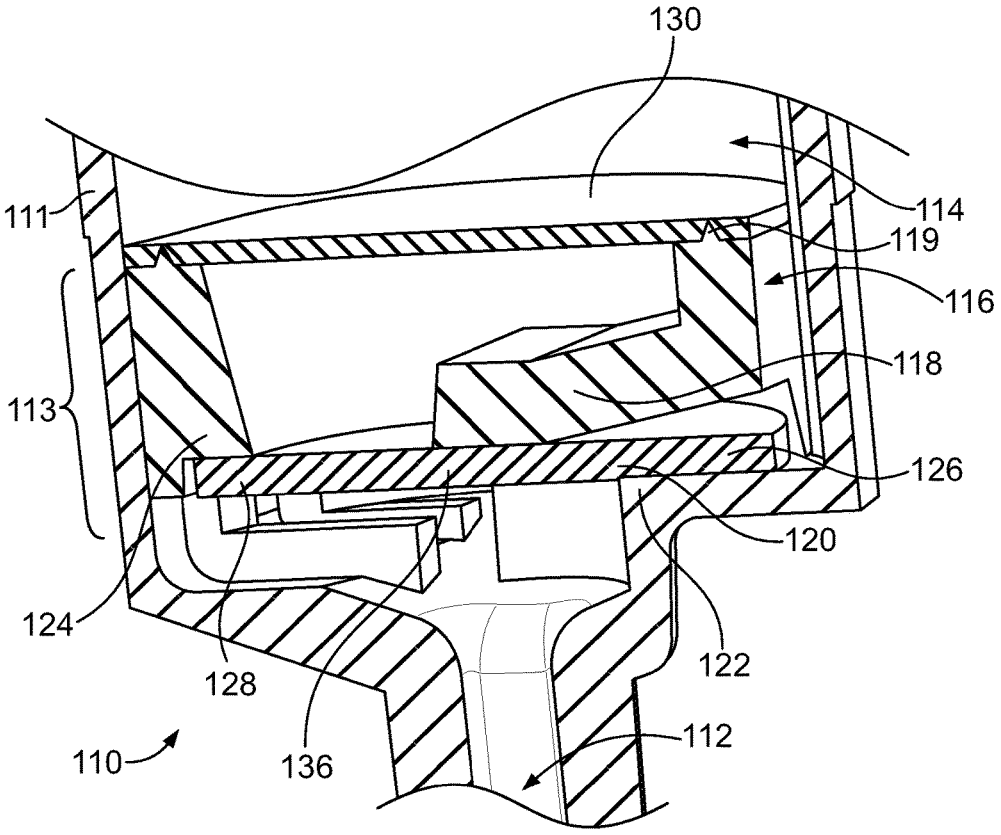
FIG. 3A is a sectional view illustrating a second embodiment of a pipette-filtration assembly with a main body having an integral lower tip, a filter mount fitted to the main body, and an upper chamber, wherein a thin membrane is configured for flexing at a first location to permit flow in a bypass channel and for flexing open at a second location to permit flow in a main channel.

FIG. 3A illustrates an alternative embodiment of a pipette-filtration assembly 110. The pipette-filtration assembly 110 has a unitary main body 111 that includes a lower tip 112, a transition region 113, and an upper chamber 114. Similar to the first embodiment, the main body 111 in the transition region 113 and the upper chamber 114 is defined by a tubular wall that is standardized to fit an air-displacement pipette that can draw air from the top of the upper chamber 114. The upper chamber 114 may include markings (see FIG. 3C) to indicate displaced volume.

A filter mount 116 is located within the transition region 113. The filter mount 116 has shaped lower surface features that allow it to be properly orientated and registered within the transition region 113, which has an asymmetric shape for receiving the filter mount 116. The filter mount 116 may include outwardly-projecting ribs or inwardly-defined depressions that are able to interact with corresponding features on the main body 111 to assist in locking the filter mount 116 in its proper location within the main body 111. The filter mount 116 is configured such that a bypass channel (see fluid flow arrow in FIG. 4A) is defined between a portion of an exterior wall of the filter mount 116 and a portion of an interior tubular wall of the main body 111. The filter mount 116 also includes an inner projection 118 that projects at a downward angle from a portion of the interior wall of the filter mount 116. A main channel (see fluid flow arrow in FIG. 4B) is defined within the filter mount 116, between the inner projection 118 and a portion of an interior wall of the filter mount 116.

The pipette-filtration assembly 110 also includes a check-valve membrane 120 and a filter 130. The check-valve membrane 120 may be located on the side of the filter mount 116 nearest the lower tip 112 and covers the main channel and the bypass channel. The check-valve membrane 120 is flexible yet resilient, such that it is able to flex or deform and then return to its prior shape. It may be composed of a thin rubber or any other suitable material. The check-valve membrane 120 is used to restrict flow in a first direction while permitting flow in a second direction. For example, the check-valve membrane 120 allows fluid to flow through the bypass channel into the upper chamber 114 while at the same time preventing fluid from flowing through the main channel into the upper chamber 114. Similarly, the check-valve membrane 120 allows fluid to flow through the main channel and out of the lower tip 112 while preventing fluid from flowing out of the bypass channel out of the lower tip 112. The first direction is generally a substantially upward direction with respect to the main body 111 and toward the pipette, while the second direction is generally a substantially downward direction with respect to the main body 111 and toward a lower portion of the main body 111. However, the first direction, the second direction, or both the first direction and the second direction may be oriented at an angle relative to the main body 111.

A portion of the main body 111 in the transition region 113 includes a bypass sealing lip 122. A first peripheral portion 126 of the check-valve membrane 120 contacts and forms a seal with the bypass sealing lip 122. The first peripheral portion 126 is able to flex towards and away from the bypass sealing lip 122 to thereby define a first valve. A portion of the filter mount 116 that encompasses the main channel includes a main sealing lip 124 around its perimeter. A second peripheral portion 128 of the check-valve membrane 120 contacts and forms a seal with the main sealing lip 124. The second peripheral portion 128 is able to flex towards and away from the main sealing lip 124 to thereby define a second valve. The first valve is able to permit fluid to flow upwards through the bypass channel while substantially inhibiting the fluid from flowing downwards through the bypass channel, which is discussed in more detail below relative to FIG. 4A. Conversely, the second valve is able to permit fluid to flow downwards through the main channel while substantially inhibiting the fluid from flowing upwards through the main channel, which is discussed in more detail below relative to FIG. 4B. A central portion 136 of the check-valve membrane 120 contacts the lower portion of the inner projection 118 such that fluid is not able to flow between the check-valve membrane 120 and the filter mount 116. The filter mount 116, the inner projection 118, and the transition region 113 of the main body 111 may include additional structural features, such as ribs or other projections, which assist in seating and confining the check-valve membrane 120, while still permitting fluid to flow through the bypass channel and the main channel. The first valve and the second valve generally do not share areas within the main body, such that fluid flowing in the bypass channel in the first direction cannot flow through the main channel in the second direction without passing through the filter 130, as described below.

The filter 130 may be located on the opposite side of the filter mount 116, towards the upper chamber 114. The filter 130 can be captured mechanically in its location to prevent flow around the filter 130, or can be welded, adhered, staked, or otherwise secured to the structure of the filter mount 116 or the upper chamber 114. The filter mount 116 may include an upwardly-projecting rib 119 that can be utilized to secure the filter 130. Additionally or alternatively, either or both of the bypass channel or main channel may be fitted with one or more additional porous filters such as a glass, plastic, or paper fiber mat, foam, or porous membrane. If more than one filter is used within the pipette-filtration assembly 110, the different filters can be of one or more porosities. Further, the filters could be impregnated with chemo-effectors for modifying the chemistry of the sample, or detection such as colorimetric or luminescent detection, dye, or the addition of drugs, antibodies, nanoparticles, or any other additions to the sample.

The configuration illustrated in FIG. 3A having the filter 130 above the check-valve membrane 120 can be reversed so that the check-valve membrane 120 is above the filter 130. Alternatively, there could be two levels of filtration, one above and one below the check-valve membrane 120. Further, the pipette-filtration assembly 110 could include two separate membranes—a first membrane for the bypass channel and a second membrane for the main channel. Any check-valve membrane in the pipette-filtration assembly 110 could fit loosely in a chamber with a lip on one side, but free to move in the axis of flow to open.

Figure 3B:
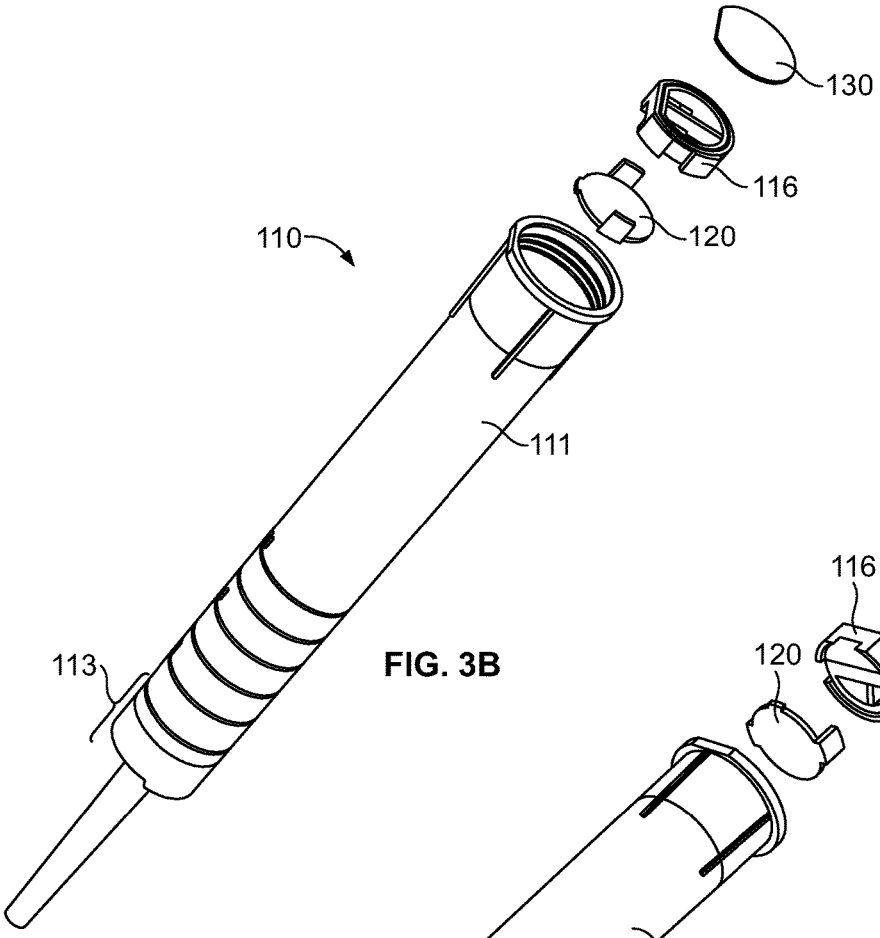
FIG. 3B is an exploded view of the pipette-filtration assembly of FIG. 3A.
Figure 3C:
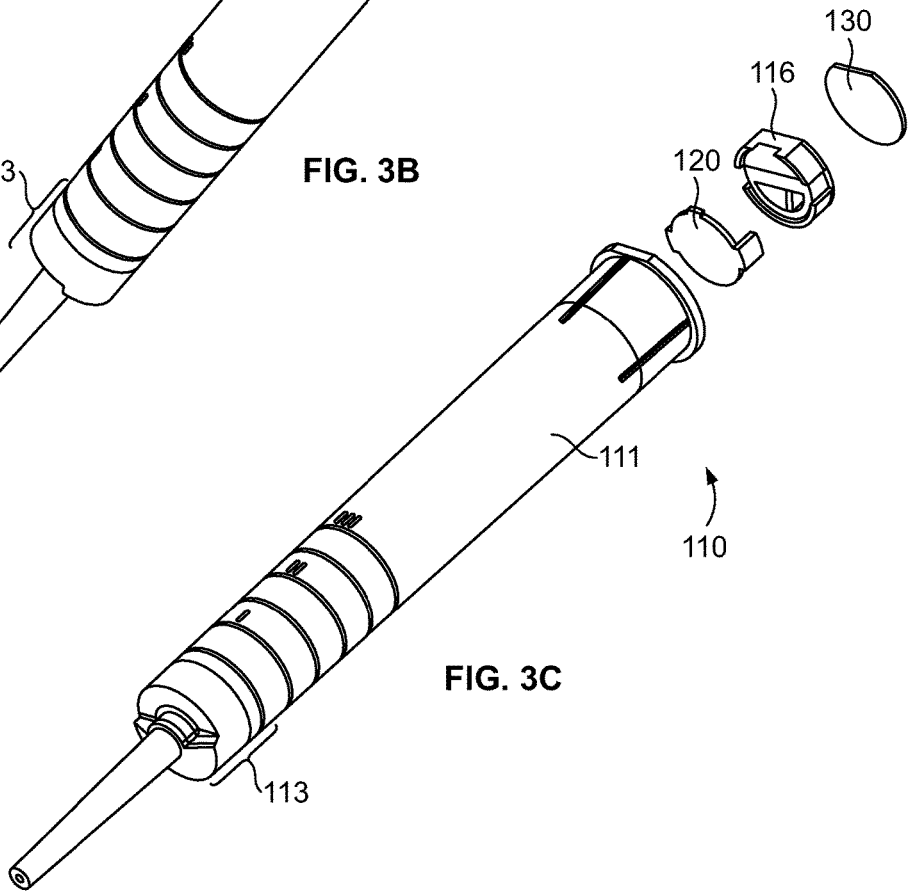
FIG. 3C is a second exploded view of pipette-filtration assembly of FIG. 3A.
Figure 5:
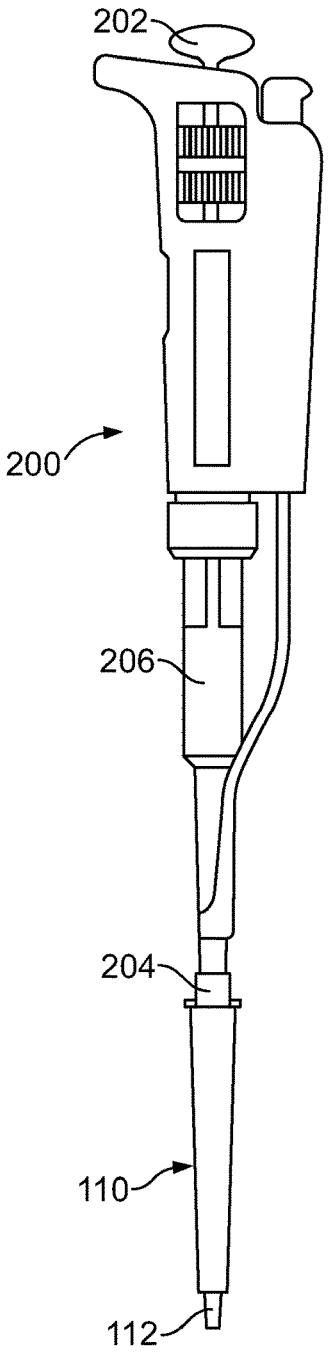
FIG. 5 is a perspective view of a pipette in combination with a pipette-filtration assembly, in accordance with the principles disclosed herein.

FIGS. 3B and 3C are exploded views of the embodiment illustrated in FIG. 3A showing the filter mount 116, the check-valve membrane 120, the filter 130, and the main body 111. The filter mount 116, the check-valve membrane 120, the filter 130 can be assembled outside the main body 111 and the slide downwardly into engagement with corresponding regions of the transition region 113 of the main body 111. The filter mount 116 may have a diameter that is slightly greater than the inside diameter of the main body 111, such that the filter mount 116 forms an interference fit (also known as a press fit or a friction fit) with the main body 111. Furthermore, the main body 111 may include stiffening, tensioning, or locking features on the inner or outer walls of the main body 111 that serve to secure the filter mount 116 against the lower end of the transition region 113. These features may also assure that the check-valve membrane 120 forms a fluid-tight seal between the lower end of the main body 111 and the underside of the filter mount 116. A series of volumetric markings are located on the main body 111 to indicate he amount of fluid sample that has been drawn upwardly though the bypass channel. The uppermost portion of the main body 111 includes structural features that permit it to be easily coupled to a pipette (preferably with a seal-right engagement), as is shown in FIGS. 5-6.

Figure 4A:
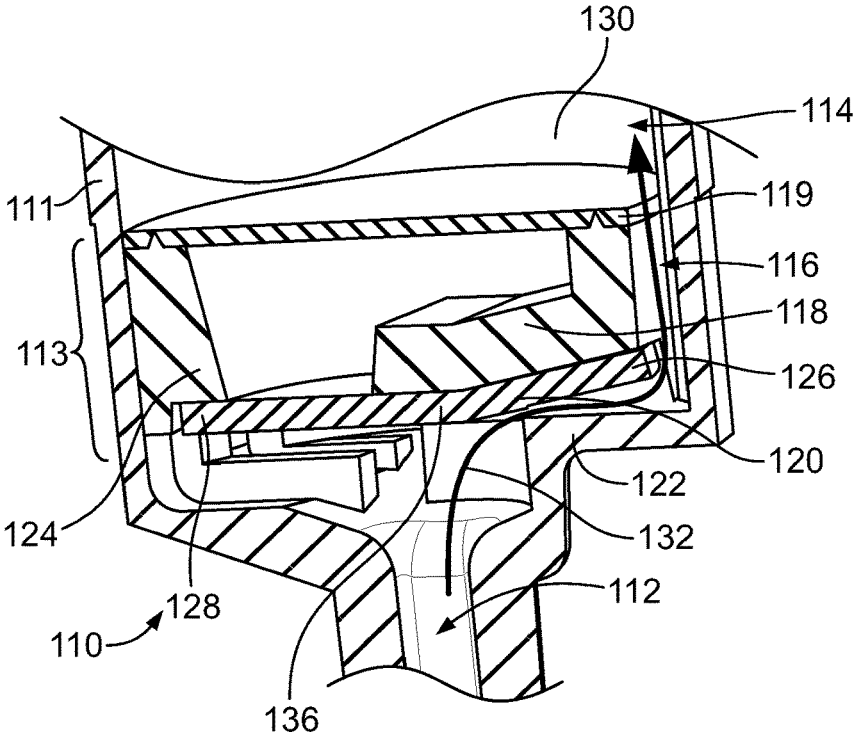
FIG. 4A is a sectional view of the pipette-filtration assembly of FIG. 3A illustrating the bypass channel during operation.

FIG. 4A illustrates the operation of the pipette-filtration assembly 110 while fluid is being drawn upwardly by the action of an attached pipette. During this part of the operation, the upper chamber 114 is at a lower pressure than the lower tip 112. The higher pressure in the lower tip 112 forces the check-valve membrane 120 upward towards the upper chamber 114. The first peripheral portion 126 of the check-valve membrane 120 deflects upwardly away from the bypass sealing lip 122 along the angle of the inner projection 118 to permit fluid to flow through the bypass channel into the upper chamber 114, as denoted by the arrow 132. The pressure on the check-valve membrane also causes the second peripheral portion 128 of the check-valve membrane to contact and form a seal with the main sealing lip 124, thereby substantially inhibiting upward flow into the upper chamber 114 through the main channel while fluid is being drawn into the pipette. The central portion 136 of the check-valve membrane 120 remains in contact with the inner projection 118 of the filter mount 116 such that no fluid is able to flow between the check-valve membrane 120 and the filter mount 116.

Figure 4B:
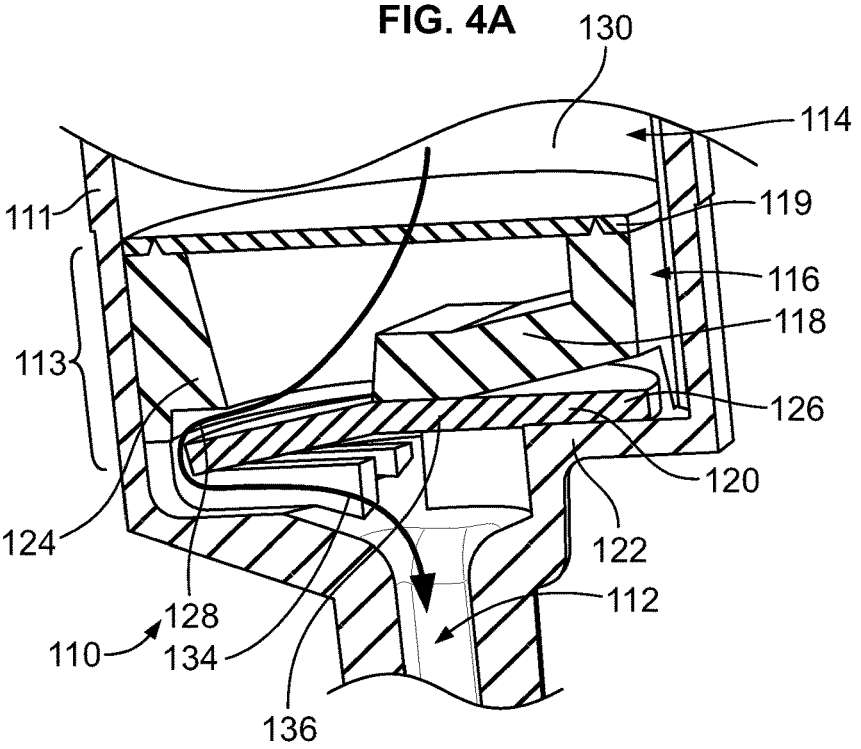
FIG. 4B is a sectional view of the pipette-filtration of FIG. 3A assembly illustrating the main channel during operation.

FIG. 4B illustrates the operation of the pipette-filtration assembly 110 while fluid is being expelled from the pipette. During this part of the operation, the upper chamber 114 will be at a higher pressure than the lower tip 112. The higher pressure in the upper chamber 114 forces the check-valve membrane 120 downwards towards the lower tip 112. The second peripheral portion 128 of the check-valve membrane 120 deflects downwardly away from the main sealing lip 124 to permit fluid to flow from the upper chamber 114 downwardly through the filter 130. The now-filtered fluid then flows in the main channel past the deflected second peripheral portion 128 and into the lower tip 112, as denoted by the arrow 134. The pressure on the check-valve membrane 120 also causes the first peripheral portion 126 of the check-valve membrane 120 to contact and form a seal with the bypass sealing lip 122, thereby substantially inhibiting downward flow into the lower tip 112 through the bypass channel while fluid is being expelled from the pipette. Again, the central portion 136 of the check-valve membrane 120 remains in contact with the inner projection 118 of the filter mount 116 such that no fluid is able to flow between the check-valve membrane 120 and the filter mount 116.

In summary, FIGS. 3A, 3B, 3C, 4A, and 4B illustrate the pipette-filtration assembly 110 having a unitary main body 111 including the lower tip 112, the transition region 113, and the upper chamber 114. The filter mount 116 is set inside the transition region 113. The filter mount 116 may have features to preclude fluid passing in the space between the filter mount 116 and the inside wall of the transition region 113, as well as features for alignment and locking the filter mount 116 in its proper location. As with other embodiments, the upper chamber 114 is defined by a tubular wall that is standardized to fit an air-displacement pipette that can draw air out of the top of the upper chamber 114. The filter mount 116 is configured with a passage on one side that forms a bypass channel with the tube wall and permits flow of a sample from the lower side of the filter mount 116 to the upper side of the filter mount 116 into the upper chamber 114, with the inside wall of the main body tube forming one wall of the bypass channel. The flexible check-valve membrane 120 (e.g. a thin rubber or resilient membrane) is used to restrict flow in one direction while permitting flow in the opposing direction. The membrane 20 is captured between the lower portion of the filter mount 116 and the bottom of the transition region 113 of the main body 111 with a feature that allows the check-valve membrane 120 to fold/defect slightly along a line across the membrane. One region of the filter mount 116 is in communication with the outlet flow channel incorporates the main sealing lip 124 around its perimeter so that the membrane 20 seats and precludes inward flow when the upper chamber 114 is at lower pressure than the lower tip 112. One region of the transition region 113 of the main body 111 in the region of the bypass channel incorporates a bypass sealing lip 122 around its perimeter so that the check-valve membrane 120 seats and precludes outward flow when the upper channel is at ambient or higher pressure than the lower tip 112. Features to assist in seating and confining the check-valve membrane 120 but permitting flow, such as ribs, may be incorporated on the filter mount 116 or transition region 113 of the main body 111.

The fluid sample is drawn by pressure into the lower tip 112 and deflects the first peripheral portion 126 of the check-valve membrane 120 away from the bypass sealing lip 122 and through the bypass channel into the upper chamber 114 of the main body 111. Venting or applying pressure to the upper chamber 114 of the main body 111 reverses the flow in the bypass channel and forces the check-valve membrane 120 to return to the bypass sealing lip 122, effectively stopping reverse flow through the bypass channel. The fluid sample flows from the upper chamber of the main body 111 through a porous filter 130 and deflects the second peripheral portion 128 of the check-valve membrane 120 away from the sealing lip 14 on the filter mount 116 permitting free flow of now-filtered sample into the lower tip 112 and out of the pipette-filtration assembly 110.

In FIG. 5 is shown the pipette-filtration assembly 110 attached to an exemplary pipette 200. The pipette 200 generally includes a thumb piece 202, a tapered end 204, and a piston 206. The pipette-filtration assembly 110 attaches to the tapered end 204 of the pipette 200. The thumb piece 202 is used to manipulate the piston 206, which in turn is able to draw fluid into and expel fluid from the pipette. Persons of skill in the art will recognize that the pipette 200 shown in FIG. 5 is merely an exemplary pipette that may be used with the pipette-filtration assembly as disclosed herein, and that other types of pipettes are able to be utilized in conjunction with the pipette-filtration assembly.

Figure 6A:
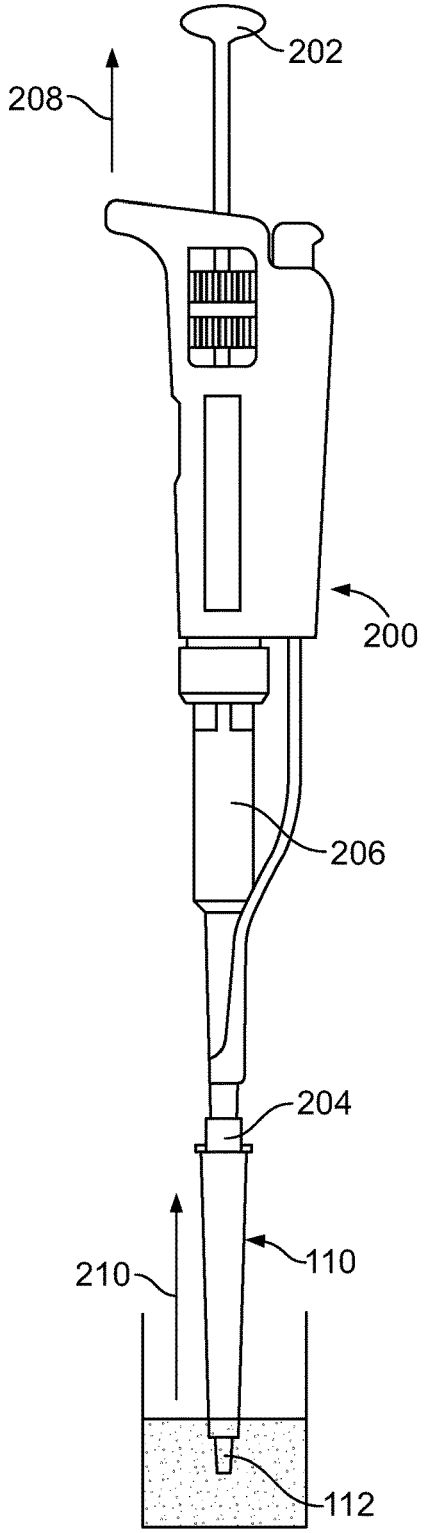
FIG. 6A illustrates the operation of a pipette and pipette-filtration assembly in drawing fluid out of a container.
Figure 6B:
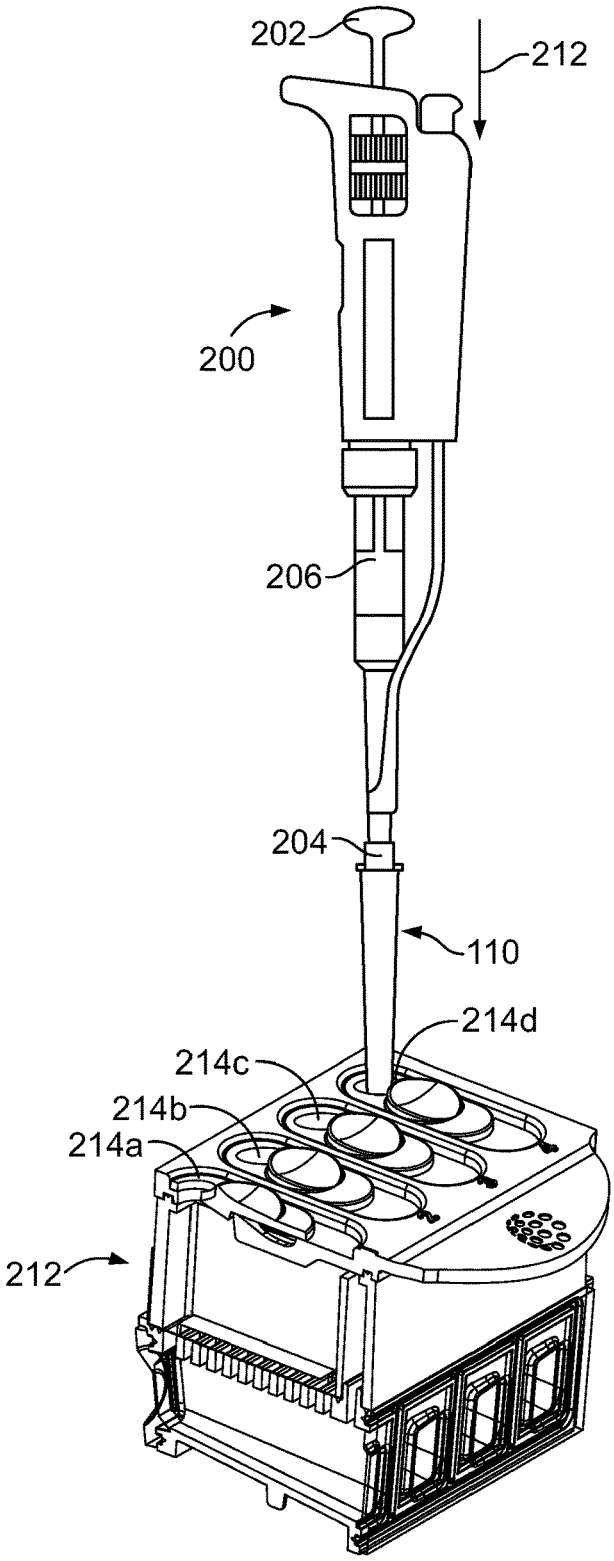
FIG. 6B illustrates the operation of a pipette and pipette-filtration assembly in depositing fluid in a cuvette, the cuvette having measurement chambers with upper openings designed to fit the lower tip of the pipette-filtration assembly.

FIGS. 6A and 6B illustrate the operation of an exemplary pipette 200 with the pipette-filtration assembly 110 attached. In FIG. 6A, the pipette 200 is inserted into a container with a fluid sample (e.g., urine) such that the lower tip of the pipette-filtration assembly 110 is submerged in the fluid. In operation, the thumb piece 202 is pulled upwards away from container of fluid, as denoted by arrow 208. This draws the piston 206 upwards, which draws fluid through the pipette-filtration assembly 110.

In FIG. 6B, the pipette 200 is shown in connection with a cuvette 212. The cuvette has four openings 214*a*, 214*b*, 214*c*, 214*d* leading to four different chambers that provide for optical measurement of the fluid samples in the four chambers. The optical measurement is preferably a forward-scattering signal measurement caused by particles (e.g., bacteria) in the fluid. The cuvette 212 is described in detail in U.S. Publication No. 2015/0160119 titled "Cuvette Assembly Having Chambers for Containing Samples to be Evaluated through Optical Measurement," filed on Dec. 5, 2014, which is commonly owned and is hereby incorporated by reference in its entirety. The lower tip 112 of the pipette-filtration assembly 110 is sized to fit within the openings 214*a*, 214*b*, 214*c*, 214*d* so as to provide a first-level of filtration for the fluid sample entering the chambers of the cuvette 212. Preferably, the main body 111 (e.g., the lower tip 112) of the pipette-filtration assembly 110 and the walls defining the openings 214*a*, 214*b*, 214*c*, 214*d* of the cuvette 212 are formed to provide a sealing effect. Further, the pressure within the pipette that moves the sample fluid into the chambers of the cuvette 212 can be transferred into the chamber of the cuvette 212. An additional level of filtration may be provided by a filter within the cuvette 212 (e.g., under the pressure applied by the pipette). Or, no additional filtration is needed after the filtering of the pipette-filtration assembly 110. In operation, the thumb piece 202 is pushed downward as shown by arrow 212, which creates the pressure to expel the fluid into a chamber of the cuvette 212 and, possibly help to urge the fluid sample (which has been subjected to at least one level of filtration via the filer 130) through a secondary filter in the cuvette 212. Accordingly, the present invention also includes the concept of the combination of the pipette-filtration assembly 110 and the cuvette (possible with an additional filter) in which the cuvette has openings sized to receive the main body 111 of the pipette-filtration assembly 110. The pipette-filtration assembly 110 is preferably disposable, allowing a user to use the same pipette multiple times with different pipette-filtration assemblies as needed.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A pipette-filtration assembly for attachment to a pipette, comprising:
   - a main body to be connected to the pipette and defining a first channel and a second channel;
   - a first valve associated with the first channel permitting flow in a first direction and substantially hindering flow in a second direction;
   - a second valve associated with the second channel permitting flow in the second direction and substantially hindering flow in the first direction;
   - a mount assembly fitting within the main body, the mount assembly having an upper region and a lower region, the lower region of the mount assembly being adjacent to a lower tip portion of the main body and having an asymmetric lower surface for mating engagement with an asymmetric-shaped inner surface of the lower tip portion of the main body, the mount assembly at least partially defining the first channel and the second channel;
   - at least one filter that filters a fluid sample as the fluid sample flows in at least one of the first direction and the second direction, the at least one filter being coupled to the upper region of the mount assembly; and
   - a membrane coupled to the lower region of the mount assembly, the membrane having a first peripheral deflectable portion associated with the first valve and a second peripheral deflectable portion associated with the second valve.

2. The pipette-filtration assembly of claim 1, further in combination with the pipette such that the pipette-filtration assembly fits onto the pipette.

3. The pipette-filtration assembly of claim 2, wherein the pipette-filtration assembly is insertable onto the pipette.

4. The pipette-filtration assembly of claim 1, wherein the main body includes multiple parts, the multiple parts at least partially defining an upper chamber, a filtration portion having the filter, and a lower tip.

5. The pipette-filtration assembly of claim 4, wherein the filtration portion includes the membrane that defines the first valve in a central region and the second valve in an outer region.

6. The pipette-filtration assembly of claim 5, wherein the at least one filter includes an annular-shaped filter that receives the sample fluid from the upper chamber prior to the filter fluid being passed through the second valve.

7. The pipette-filtration assembly of claims 1, in combination with a cuvette having an opening that is sized to engage outer walls defining the lower tip portion of the main body.

8. The pipette-filtration and cuvette assembly of claim 7, wherein a second level of filtration is provided within the cuvette.

9. The pipette-filtration assembly of claim 1, wherein the main body is unitary.

10. A pipette-filtration assembly for attachment to a pipette, comprising:
   - a main body having a lower portion for receiving and expelling a fluid sample and an upper portion for attachment to the pipette, the lower portion of the main body having an asymmetric-shaped inner surface;
   - a filter mount located within the main body and including at least one filter for filtering the fluid sample, the filter mount and the main body defining a bypass channel, the filter mount defining a main channel, the filter mount having a lower region with an asymmetric surface for mating engagement with the asymmetric-shaped inner surface of the lower portion of the main body; and a check-valve membrane located within the main body and coupled to the filter mount, the check-valve membrane defining a first valve and a second valve, the first valve being associated with the bypass channel to thereby permit flow in a first direction and substantially hinder flow in a second direction, and the second valve being associated with the main channel to thereby permit flow in the second direction and substantially hinder flow in the first direction.

11. The pipette-filtration assembly of claim 10, further in combination with the pipette, the pipette-filtration assembly fitting onto a lower portion of the pipette, the first direction being an upward direction toward the pipette, the second direction being in a downward direction toward the lower portion of the main body.

12. The pipette-filtration assembly of claim 10, wherein the bypass channel is defined between a portion of an interior wall of the main body and a portion of an exterior wall of the filter mount.

13. The pipette-filtration assembly of claim 10, wherein the filter mount includes an inner projection, and the main channel is defined between a portion of an interior wall of the filter mount and the inner projection.

14. The pipette-filtration assembly of claim 10 wherein the filter is attached to the filter mount such that only fluid flowing through the main channel is filtered.

15. The pipette-filtration assembly of claim 10, wherein the check-valve membrane has a first peripheral portion and a second peripheral portion, the first valve being formed from the first peripheral portion contacting the main body and the second valve being formed from the second peripheral portion contacting the filter mount.

16. The pipette-filtration assembly of claim 15, wherein the main body has a bypass sealing lip and the filter mount has a main sealing lip, and wherein the first peripheral portion is configured to flex towards and away from the bypass sealing lip, thereby defining the first valve, and the second peripheral portion is configured to flex towards and away from the main sealing lip, thereby defining the second valve.

17. The pipette-filtration assembly of claim 10, wherein the main body is unitary.

* * * * *